US005744294A

United States Patent [19]

Dickerson et al.

[11] Patent Number: 5,744,294

[45] Date of Patent: Apr. 28, 1998

[54] RADIOGRAPHIC ELEMENT MODIFIED TO PROVIDE PROTECTION FROM VISUAL FATIGUE

[75] Inventors: Robert E. Dickerson, Hamlin; Rickey J. Seyler, Hilton, both of N.Y.

[73] Assignee: Eastman Kodak Company, Rochester, N.Y.

[21] Appl. No.: 846,696

[22] Filed: Apr. 30, 1997

[51] Int. Cl.[6] ..... G03C 1/04

[52] U.S. Cl. ..... 430/521; 430/517; 430/559; 430/627

[58] Field of Search ..... 430/517, 521, 430/559, 627

[56] References Cited

U.S. PATENT DOCUMENTS

| | | | |
|---|---|---|---|
| 3,488,195 | 1/1970 | Hunter | 430/501 |
| 3,849,139 | 11/1974 | Hibino et al. | 430/521 |
| 4,252,421 | 2/1981 | Foley, Jr. | 351/162 |
| 4,267,306 | 5/1981 | Davis et al. | 528/226 |
| 4,804,719 | 2/1989 | Weaver | 525/420 |
| 4,999,418 | 3/1991 | Krutak et al. | 528/272 |
| 5,292,627 | 3/1994 | Hershey et al. | 430/356 |
| 5,292,855 | 3/1994 | Krutak et al. | 528/289 |
| 5,372,864 | 12/1994 | Weaver et al. | 428/36.92 |
| 5,384,377 | 1/1995 | Weaver et al. | 525/437 |
| 5,468,599 | 11/1995 | Biavasco et al. | 430/512 |

OTHER PUBLICATIONS

Reasearch Disclosure, vol. 184, Aug. 1979, Item 18431, XII. Film Supports.

*Primary Examiner*—Hoa Van Le
*Attorney, Agent, or Firm*—Carl O. Thomas

[57] ABSTRACT

A radiographic element including an image recording silver halide emulsion layer coated on a transparent film support and a blue anthraquinone dye. Transmission of red light through the exposed and processed radiographic element is reduced by coating on the support at least one ionic linear condensation polymer containing a cyan phthalocyanine dye.

12 Claims, No Drawings

RADIOGRAPHIC ELEMENT MODIFIED TO PROVIDE PROTECTION FROM VISUAL FATIGUE

FIELD OF THE INVENTION

The invention relates to an element for recording an image pattern of X-radiation exposure. More specifically, the invention relates to radiographic elements containing at least one radiation-sensitive silver halide emulsion layer.

DEFINITION OF TERMS

The term "intensifying screen" is employed to indicate an element capable of absorbing an image pattern of X-radiation and emitting a corresponding image pattern of visible light.

The term "radiographic element" designates an element capable of forming a visible image corresponding to an image pattern of X-radiation.

Radiographic elements include elements capable of producing a viewable image following exposure to an imagewise pattern of X-radiation, elements capable of producing a viewable image following exposure by an intensifying screen which has received an imagewise X-radiation exposure, duplicating elements that are designed to be exposed through an image bearing radiographic element, and elements that are exposed by a laser or other controlled light source to recreate a digitally stored radiographic image.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "warmer" in referring to image tone are used to mean CIELAB b* values measured at minimum density that are more negative or positive, respectively. The b* values describe the yellowness vs. blueness of an image with more positive values indicating a tendency toward greater yellowness. a* values compare greeness vs. redness with more positive values indicating a relatively higher proportion of red light. a* and b* measurement techniques are described by Billmeyer and Saltzman, *Principles of Color Technology*, 2nd. Ed., Wiley, New York, 1981, at Chapter 3. a* and b* measurements were developed by the Commission International de l'Esclairage (International Commission on Illumination).

In referring to grains and emulsions containing two or more halides, the halides are named in order of ascending concentrations.

The terms "high bromide" and "high chloride" in referring to grains and emulsions indicates that bromide or chloride, respectively, is present in concentrations of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "polyester ionomer" indicates a polyester that contains at least one ionic moiety.

The term "half peak absorption bandwidth" refers to the spectral range in nm over which a dye exhibits a level of absorption equal to at least half of its peak absorption ($\lambda_{max}$)

*Research Disclosure* is published by Kenneth Mason Publications, Ltd., Dudley House, 12 North St., Emsworth, Hampshire P010 7DQ, England.

BACKGROUND

Radiographic elements are commonly formed by coating hydrophilic colloid layers on one or both sides of a transparent film support. At least one of the hydrophilic colloid layers contains a radiation-sensitive silver halide emulsion that forms a latent image when imagewise exposed to X-radiation and/or light.

Upon subsequent processing in a developer and then a fixing solution, followed by rinsing and drying, a viewable silver image is created in the radiographic element. Radiographic images are commonly "read" by placing a fully processed element on a light box, which transmits diffuse white light to and through the radiographic element for viewing. The viewer then sees the silver image in the film against a bright, backlit background.

In medical diagnostic imaging, which is by far the largest end use for radiographic elements, radiologists require a cold (i.e., blue-black) image tone. A cold image tone reduces eye strain and, by years of use, has become an aesthetic requirement for film acceptance and use by radiologists. The quantitative technique for verifying how "cold" or "warm" an image is by b* value determination.

While adding toning agents to the emulsion layers is a known expedient for producing colder image tones, as illustrated by Hershey U.S. Pat. No. 5,292,627, a more generally used technique is to incorporate a blue dye in the transparent film support. This provides an overall blue tint to the film as it is being viewed and causes the developed silver image to appear colder. Typically anthraquinone dyes are incorporated in the support as blue tinting dyes. Such dyes are illustrated by *Research Disclosure*, Vol. 184, August 1979, Item 18431, XII. Film Supports. Anthraquinone dyes have been chosen for support incorporation, since they are thermally stable at the elevated temperatures at which polymeric (typically, polyester) films supports are formed.

Biavasco et al U.S. Pat. No. 5,468,599 discloses adding phthalocyanine blue pigment to a hydrophilic colloid layer of a photographic element containing a spectrally sensitized tabular grain emulsion to reduce minimum density and reduce dye stain.

The modification of polyesters and polyamides by the incorporation of a dye chromophore is disclosed by Davis et al U.S. Pat. No. 4,267,306, Weaver et al U.S. Pat. Nos. 4,804,719, 5,372,864 and 5,384,377, and Krutak et al U.S. Pat. Nos. 4,999,418 and 5,292,855.

RELATED APPLICATION

Dickerson et al U.S. Ser. No. 08/812,634 filed Mar. 7, 1997, commonly assigned, titled ELEMENTS CONTAINING BLUE TINTED HYDROPHILIC COLLOID LAYERS, discloses a radiographic element having a transparent film support and hydrophilic colloid layers including at least one silver halide emulsion layer coated on the support. Upon viewing following imagewise exposure and processing, the radiographic element exhibits a transparent blue appearance in areas of minimum density, at least a portion of the blue appearance being attributable to the presence in one or more of the hydrophilic colloid layers of at least one ionic linear condensation polymer containing an anthraquinone dye chromophore.

PROBLEM TO BE SOLVED

Although anthraquinone dyes adequately serve the purpose of producing cold image tones, it has been observed that imagewise exposed and processed radiographic elements when visually examined on a light box can still produce undesirably high levels of visual fatigue, even when the image tones appear "cold" and the coldness of the image is quantitatively verified by b* values.

SUMMARY OF THE INVENTION

It has been discovered that a significant component of the visual fatigue associated with reading radiographic images can be traced to the level of red light transmission which occurs through an imagewise exposed and fully processed radiographic element when read on light box.

This invention has as it purpose to modify a radiographic element so that it transmits a lower proportion of red light when viewed following imagewise exposure and processing.

In one aspect, this invention is directed to a radiographic element comprised of (1) a transparent film support having first and second major faces, (2) hydrophilic colloid layers coated on at least one of the first and second major faces including at least one radiation-sensitive silver halide emulsion layer, and (3) a blue anthraquinone dye forming a portion of at least one of the support and the hydrophilic colloid layers, WHEREIN, transmission of red light through the radiographic element when imagewise exposed and processed to produce a viewable image is reduced by the incorporation in at least one of the hydrophilic colloid layers of at least one ionic linear condensation polymer containing a cyan phthalocyanine dye.

Surprisingly, these phthalocyanine dye containing polymers offer a combination of performance features that render them superior for the function they are called upon to perform. First, the phthalocyanine dye chromophore is itself highly thermally stable, allowing manufacture and processing of the film at elevated temperatures with minimal risk of thermally degrading the dye chromophore. Second, by incorporating the phthalocyanine dye within an ionic linear condensation polymer, it is readily incorporated in one or more of the hydrophilic colloid layers forming the radiographic element. Third, incorporating the dye chromophore as a repeating unit within a polymer eliminates problems of dye loss through migration or sublimation during the course of radiographic film manufacture. In short, ionic linear condensation polymer containing the phthalocyanine dye efficiently performs the function of reducing red light transmission while also offering outstanding properties of stability.

PREFERRED EMBODIMENTS

The present invention is an improvement on radiographic elements that have been blue tinted by the incorporation of an anthraquinone dye. Red light transmission remaining after anthraquinone dye incorporation is further reduced by incorporating in the radiographic elements an ionic linear condensation polymer containing a cyan phthalocyanine dye.

Conventionally anthraquinone dye employed for blue tinting is incorporated in the transparent film support of the radiographic element. As a further optional, but preferred feature which has not been previously taught in the art, it is contemplated to additionally or as an alternative incorporate the anthraquinone dye in one or more of the hydrophilic colloid layers forming the radiographic elements.

Radiographic elements satisfying the requirements of the invention can be constructed in either a single-sided or dual-coated format, as shown below:

| |
|---|
| Front Hydrophilic Colloid Layer Unit (FHCLU) |
| Transparent Film Support (S) |
| Back Hydrophilic Colloid Layer Unit (BHCLU) |
| Element I |
| Hydrophilic Colloid Layer Unit (HCLU) |
| Transparent Film Support (S) |
| Pelloid (P) |
| Element II |

The transparent film support S is transparent to radiation employed for imagewise exposure of the film. Additionally, the film support is transparent in the visible region of the spectrum to permit transmission of diffuse light from a light box through the element during viewing following exposure and processing.

Although it is possible for the transparent film support to consist of a flexible transparent film, the usual construction is as follows:

| |
|---|
| Surface Modifying Layer Unit (SMLU) |
| Transparent Film (TF) |
| Surface Modifying Layer Unit (SMLU) |

Since the transparent film TF is typically hydrophobic, it is conventional practice to provide surface modifying layer units SMLU to promote adhesion of the hydrophilic colloid layers to the front and back of the transparent film. Each surface modifying layer unit typically consists of a subbing layer overcoated with a thin, hardened hydrophilic colloid layer.

While any conventional transparent photographic or radiographic film support can be employed, the transparent film TF is preferably constructed of a polyester, to maximize dimensional integrity, rather than employing cellulose acetate supports as are most commonly employed in photographic elements.

The transparent film can be colorless or can be blue tinted. When the transparent film support is blue tinted, it is preferred to that the level of blue tint be limited to the minimum level required for the radiographic application to be served. For example, whereas currently a series of otherwise identical films are manufactured having film supports of differing levels of blue tinting to meet varied user preferences, Item 18431, cited above, Section XII. Film Supports. *Research Disclosure,* Vol. 389, September 1996, Item 38957, Section XV. Supports, illustrates in paragraph (2) suitable surface modifying layer units, particularly the subbing layer components, to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthalate) are specifically preferred polyester film supports.

In the simplest contemplated form of the invention each of FHCLU, BHCLU and HCLU consists of a single radiation-sensitive silver halide emulsion layer. Preferably each of FHCLU, BHCLU and HCLU consists of the following sequence of layer units:

| |
|---|
| Protective Layer Unit (PLU) |
| Emulsion Layer Unit (ELU) |
| Underlying Layer Unit (ULU) |

where ULU is coated nearest the transparent film support S. ELU in most instances consists of a single radiation-sensitive silver halide emulsion layer, but can advantageously include two or more emulsion layers. For example, it is common practice to coat faster and slower emulsions in separate layers. It is also possible to reduce vehicle requirements by transferring a portion of the radiation-sensitive silver halide grains from ELU to ULU, thereby, in effect, converting ULU to an emulsion layer unit.

Except for the possible inclusion of an ionic linear condensation polymer, as discussed below, each of the layers of the hydrophilic colloid layer units can take any convenient conventional form. The following patents, here incorporated by reference, illustrate radiographic element constructions, which, except for lacking an ionic linear condensation polymer containing a dye chromophore, are within the contemplation of the invention:

| | |
|---|---|
| Dickerson | U.S. Pat. No. 4,414,304; |
| Abbott et al | U.S. Pat. No. 4,425,425; |
| Abbott et al | U.S. Pat. No. 4,425,426; |
| Dickerson | U.S. Pat. No. 4,520,098; |
| Daubendiek et al | U.S. Pat. No. 4,639,411; |
| Dickerson et al | U.S. Pat. No. 4,803,150; |
| Abbott et al | U.S. Pat. No. 4,865,958; |
| Dickerson et al | U.S. Pat. No. 4,900,652; |
| Dickerson et al | U.S. Pat. No. 4,994,355; |
| Dickerson et al | U.S. Pat. No. 4,997,750; |
| Bunch et al | U.S. Pat. No. 5,021,327; |
| Dickerson et al | U.S. Pat. No. 5,041,364; |
| Dickerson et al | U.S. Pat. No. 5,108,881; |
| Dickerson et al | U.S. Pat. No. 5,196,299; |
| Pruett et al | U.S. Pat. No. 5,215,876; |
| Dickerson et al | U.S. Pat. No. 5,252,442; |
| Dickerson | U.S. Pat. No. 5,252,443; |
| Hershey et al | U.S. Pat. No. 5,292,627; |
| Hershey et al | U.S. Pat. No. 5,292,631; |

-continued

| | |
|---|---|
| Hershey et al | U.S. Pat. No. 5,314,790; |
| Zietlow | U.S. Pat. No. 5,370,977; |
| Dickerson | U.S. Pat. No. 5,391,469; |
| Dickerson et al | U.S. Pat. No. 5,399,470; |
| Jones et al | U.S. Pat. No. 5,491,058; |
| Fenton et al | U.S. Pat. No. 5,567,580; and |
| Dickerson | U.S. Pat. No. 5,576,156. |

All of the layers of the radiographic elements, except as noted in connection with the support S, are hydrophilic colloid layers. They employ a hydrophilic colloid, typically gelatin or a gelatin derivative as a vehicle. Conventional vehicles and modifying components contemplated for use in the hydrophilic colloid layer units of the radiographic elements of the invention are disclosed in *Research Disclosure*, Item 38957, cited above, II. Vehicles, vehicle extenders, vehicle-like addenda and vehicle related addenda.

A more general description of PLU constructions and their components is provided by *Research Disclosure*, Item 18431, cited above, III. Antistatic Agents/Layers and IV. Overcoat Layers, and *Research Disclosure*, Item 38957, cited above, IX. Coating physical property modifying addenda, A. Coating aids, B. Plasticizers and lubricants, C. Antistats, and D. Matting agents. It is common practice to divide PLU into a surface overcoat and an interlayer. The interlayers are typically thin hydrophilic colloid layers that provide a separation between the emulsion and the surface overcoat addenda. It is quite common to locate surface overcoat addenda, particularly anti-matte particles, in the interlayer.

The underlying layer unit ULU provides a convenient location for processing solution decolorizable microcrystalline dyes that are optionally, but commonly used to reduce crossover in dual-coated Element I constructions.

Preferred processing solution microcrystalline dyes are disclosed by Dickerson et al U.S. Pat. Nos. 4,803,150 and 4,900,652, cited and incorporated by reference above, and Diehl et al 4,940,654. It is possible to locate microcrystalline dyes in an emulsion layer, allowing ULU to be entirely eliminated. A preferred radiographic element construction is to place the microcrystalline dye in an emulsion layer coated nearest the support which is overcoated with a second, faster emulsion layer. In Element II constructions processing solution decolorizable microcrystalline dye can be incorporated in ULU to act as an antihalation dye. However, in Element II constructions the preferred location for antihalation dye is in the pelloid P.

The pelloid P in Element II is provided to offset physical forces exerted on the support by the emulsion and any other layers coated on the opposite side of the support, thereby protecting the element from any tendency toward curl. When the pelloid is constructed of a hydrophilic colloid vehicle, the pelloid is also an ideal location for processing solution decolorizable antihalation dye incorporation. The microcrystalline dyes set out by Dickerson et al and Diehl et al, cited in the preceding paragraph, can also be used as antihalation dyes. A general summarizing of processing solution decolorizable antihalation dyes is set out in *Research Disclosure*, Item 38957, cited above, VIII. Absorbing and scattering materials, B. Absorbing materials and C. Discharge. Since P is also a surface layer, it can also contain the various addenda described above in connection with PLU. Although preferred in most instances, the pelloid layer is not essential.

Although radiation-sensitive silver halide emulsions are generally useful in the radiographic elements of the invention and can take varied conventional forms, as illustrated *Research Disclosure*, Item 38957, cited above, I.

Emulsion grains and their preparation, the preferred emulsions for incorporation in the radiographic elements of the invention are comprised of silver bromide optionally containing up to about 3 mole percent iodide, based on the total weight of silver. Preferred ELU constructions are those that include at least one tabular grain emulsion. The fastest attainable rates of processing are realized when high chloride tabular grain emulsions are employed.

Radiographic elements containing one or more tabular grain emulsions are particularly improved by the incorporation of a blue anthraquinone dye chromophores, since it is generally appreciated that tabular grains produce progressively warmer image tones as the mean thickness of the tabular grains is decreased, whereas imaging performance is otherwise generally improved. Thus, the present invention specifically contemplates the use of tabular grain emulsions having mean grain thicknesses of less than 0.2 μm. Mean tabular grain thicknesses as low as 0.03 μm are known, but, to avoid undesirably warm image tones, mean tabular grain thicknesses of at least 0.1 μm are preferred.

The ionic linear condensation polymers containing a cyan phthalocyanine dye chromophore incorporated in one or more of the hydrophilic colloid layers of the radiographic elements can be formed by modifying the structure of a conventional linear condensation polymer. Linear condensation polymers are conventionally formed by reacting a Type I monomer having two reactive moieties of a first type (typically basic moieties) with a Type II monomer having two reactive moieties of a second type (typically acidic moieties), where the first and second type moieties are chosen to enter into a condensation reaction with each other. This can be illustrated as follows:

$$R^1—T^1—R^1+R^2—T^2—R^2=T^3—(T^1—L—T^2—L)_m—T^4 \quad (III)$$

where $R^1—T^1—R^1$ is a Type I monomer, $R^2—T^2—R^2$ is a Type II monomer,

L is a linking group that results when $R^1$ and $R^2$enter into a condensation reaction, m is an integer chosen to provide a desired molecular weight, and $T^3$ and $T^4$ are chain terminating groups.

When the $R^1$ reactive groups are hydroxy groups, $T^1$ preferably takes the form an alkyl group of from 1 to 6 carbon atoms. Thus, in a simple preferred form $R^1—T^1—R^1$ is a glycol, most preferably ethylene glycol. In a common variant form $T^1$ can contain from 2 to 12 carbon atoms and contain an internal oxy (—O—) ether linkage between carbon atoms. Alternatively, in forming polyamides, $R^1$ can take the form of a primary ($—NH_2$) or secondary amino ($—NHR^3$) group. $R^3$ is preferably alkyl of from 1 to 6 carbon atoms.

The $R^2$ reactive groups can be chosen from among carboxy groups [—C(O)OH]; carbonyl halide groups [—C(O)X, where X is a halide, typically chloride or bromide]; or ester groups [$—OC(O)R^4$, $—OC(O)OR^4$, $OC(O)NHR^4$, or $—C(O)OR^4$, where $R^4$ is alkyl, cycloalkyl or aryl, containing up to 10 carbon atoms]. Preferred ester groups are $—C(O)OR^4$ groups. Preferred $R^4$ alkyl groups contain from 1 to 6 carbon atoms. Preferred $R^4$ cycloalkyl groups are those containing from 3 to 8 ring carbon atoms, most preferably cyclopentyl and cyclohexyl groups. Preferred aryl groups are phenyl and naphthyl groups.

$T^2$ preferably takes the form of a phenylene or naphthylene group. Most commonly $R^2—T^2—R^2$ is phthalic, terephthalic or isophthalic acid or an esterified derivative. Dearomatized (hydro) variants of phthalic and terephthalic acids are also conventionally employed in forming polyesters.

To allow the linear condensation polymer to be dispersed in a hydrophilic colloid vehicle present in the radiographic element it is necessary to modify at least a portion of the Type I or Type II repeating units making up the polymer so that they contain an ionic moiety. One approach for achieving this result is to substitute for a portion of the $R^2—T^2—R^2$ monomer a corresponding monomer containing an ionic substituent. When the linear condensation polymer is a polyester, a preferred form, addition of the ionic substituents converts the polyester to a polyester ionomer, a polyester formed by the condensation of ionic monomeric units. In a specifically preferred form of the invention the ionic linear condensation polymers employed in the radiographic elements of the invention are polyester ionomers.

A preferred ionic substituent is a sulfo group($—SO_3^-M^+$). M can be any convenient counterion, such as hydrogen ($H^+$), alkali metal (e.g., $Li^+$, $Na^+$ or $K^+$) or alkaline earth metal (e.g., $Mg^{++}$ or $Ca^{++}$). Specifically preferred sulfo-substituted repeating units are sulfo-substituted phthalic, terephthalic or isophthalic acid (and phthalic acid derivative) repeating units, particularly sulfo-substituted isophthalic acid or a derivative, such as one of the derivative forms discussed above—e.g. a carbonylhalide or ester form noted above. The sulfo group need not be a direct substituent of the diacid benzene ring, but can be attached through an intermediate linking group, taking a form such as sulfoalkyl, sulfoalkyloxy, sulfoaryl or sulfoaryloxy, where the alkyl moieties contain from 1 to 6 carbon atoms and the aryl moieties are preferably phenyl moieties.

As an alternative to a sulfo substituent, it is contemplated to employ a substituent containing a sulfoimino [$—SO_2—N—(M^+)—$] moiety. The substituent can, for example, satisfy the formula:

$$—SO_2—N^-(M^+)—(SO_2)_n—Y \quad (IV)$$

wherein

M is as defined above, n is zero or 1, and

Y is alkyl of from 1 to 6 carbon atoms or aryl of from 6 to 12 carbon atoms, preferably phenyl.

It is also possible to incorporate disulfoimino moiety into the linear condensation polymer backbone by constructing the $R^2—T^2—R^2$ monomer described above to satisfy the formula:

$$R^3—C(O)Ar^1—SO_2—N^-(M^+)—SO_2—Ar^2C(O)—R^3 \quad (V)$$

wherein $R^3$ represents the atoms completing a carboxylic acid, carbonylhalide or ester moiety, as described above; and $Ar^1$ and $Ar^2$ are arylene moieties containing from 6 to 10 carbon atoms, preferably m or p-phenylene moieties.

Illustrations of linear condensation polymers generally and polyester ionomers in particular containing repeating pendant or backbone ionic moieties of the type described above are provided by Noonan et al U.S. Pat. Nos. 4,097,282, 4,252,921, 4,291,153, and 4,419,437 and Weaver et al et al U.S. Pat. No. 4,804,719, the disclosures of which are here incorporated by reference.

The incorporation of the ionic repeating units is adjusted as required to render the linear condensation polymer hydrophilic. Taking the sum of the terminal, basic (Type I), and acidic (Type II) groups forming the linear condensation polymer as 100 mole percent, the ionic repeating units can impart hydrophilic characteristics in concentrations of 1 mole percent or less. It is generally preferred that the ionic repeating units account for at least 5 mole percent of the polymer. By rendering the linear condensation polymer hydrophilic it can be acceptably mechanically blended with the hydrophilic colloid vehicle. As the proportion of the ionic repeating units in condensation polymer is increased the ease of obtaining a uniform distribution within the hydrophilic colloid vehicle is increased. No advantage has been identified for increasing the proportion of ionic repeating units beyond 40 mole percent of the condensation polymer. Generally convenient physical handling properties are observed in the ionic linear condensation polymer when overall molecular weights are maintained in the range of from about 10,000 to 100,000.

The ionic linear condensation polymer additionally contains repeating units containing a cyan phthalocyanine dye to absorb red light that would otherwise be transmitted through the radiographic element. The cyan dye is chosen to have a half-peak absorption bandwidth having its shortest wavelength equal to or greater than 600 nm. By confining the minimum wavelength of the half-peak bandwidth to 600 nm or longer, the principal absorption by the phthalocyanine dye lies outside the principal spectral regions of intensifying screen exposure, which are typically in the blue and green portions of the spectrum and, preferably, the latter. The half-peak absorption bandwidth of the phthalocyanine dye preferably extends over at least 50 nm of the 100 nm spectral region of from 600 to 700 nm. There is no disadvantage to having the half-peak absorption bandwidth of the phthalocyanine dye extend into the near infrared region of the spectrum.

When the radiographic element is a duplicating film intended to be exposed by photodiodides or a laser, such as a helium-neon laser, emitting in the red region of the spectrum, the cyan phthalocyanine dye half-peak absorption can overlap the spectral region of imagewise exposure. However, since the optical density of the phthalocyanine dye in the spectral region of its half-peak absorption bandwidth is typically limited to less than 0.2 and preferably less than 0. 1, only a small adjustment of the controlled exposure light source is required to offset competing absorption by the phthalocyanine dye. Notice that this differs from medical diagnostic imaging employing intensifying screens. In the latter instance competing absorption by the phthalocyanine dye translates into higher patient exposures to X-radiation and is therefore avoided in dye selection.

The phthalocyanine dye is preferably incorporated in the ionic linear condensation polymer from a monomer satisfying the formula:

$$E—Pc—E \qquad (VI)$$

where

Pc is an optionally substituted phthalocyanine dye chromophore and

E is a reactive group $R^1$ or $R^2$, described above, which is preferably linked to the phthalocyanine dye chromophore through a linking group.

A particularly preferred linking group is a sulfamoyl group satisfying the formula:

$$-SO_2\overset{\overset{R^6}{|}}{N}-R^7-R^8 \qquad (VII)$$

wherein $R^6$ is hydrogen or alkyl containing from 1 to 6 carbon atoms;

$R^7$ is alkylene containing from 1 to 6 carbon atoms, such as methylene, ethylene, iso-butylene or neo-pentylene; and $R^8$ is $R^1$ or $R^2$, most preferably $R^1$.

The basic chromophore of a phthalocyanine dye exhibits the following structure:

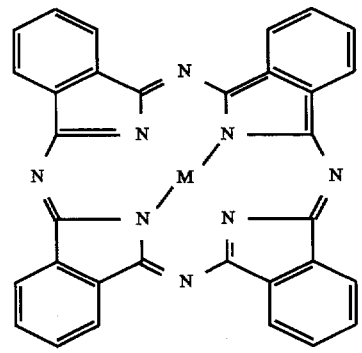

(VIII)

where M can be two separate hydrogen atoms or a metal atom, which can be further substituted with halogen, oxy, or organo groups. Preferably M is a divalent metal, such as copper, calcium, cobalt, iron, gallium, magnesium, manganese, nickel, lead, platinum, palladium, tin or zinc. Metals having a valence of three or four can additionally have a halogen, oxy, thioxy or organic substituent, as illustrated by AlCl, AlBr, AlF, AlOH, $AlOR^9$, $AlSR^9$, $Ge(OR^{10})_2$, InCl, $SiCl_2$, $SiF_2$, $Si(OR^{10})_2$, $SnCl_2$, $Sn(OR^{10})_2$, $Si(SR^{10})_2$, TiO and VO. $R^9$ and $R^{10}$ can be hydrogen or organic moieties, such as alkyl, aryl, aralkyl, or alkaryl groups linked directly or are through carbonyl, amido or carbamoyl linking groups, and containing a total of 1 to 20 (preferably 1 to 6) carbon atoms. One of the $R^9$ or $R^{10}$ moieties can take the form $$-\overset{\overset{R^{11}}{|}}{\underset{\underset{R^{13}}{|}}{M'}}-R^{12} \qquad (IX)$$

where

M' is Sn, Si or Ge, $R^{11}$, $R^{12}$ and $R^{13}$ can be independently selected to take the form of $—O_m—R^{14}$, m is zero or 1, $R^{14}$ is halogen when m is zero or selected from any of the organic moieties named above forming $R^9$ or $R^{10}$. Preferably the organic moieties forming $R^9$, $R^{10}$ and $R^{14}$ are alkyl or alkoxy, phenyl, or alkylphenyl, where the alkyl moieties contain from 1 to 6 carbon atoms.

The phthalocyanine dye chromophore can be substituted, if desired. Substituents can be employed to adjust the hue of the dye chromophore to a specific spectral region. As employed herein the term "phthalocyanine" is employed to encompass, as an optionally substituted form of phthalocyanine, napthocyanine, such as illustrated by the formula:

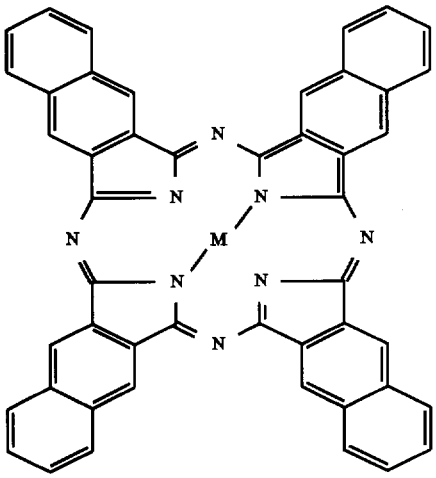

(X)

where M is as defined above.

Further, optional substituents of the chromophores of formulae IX and X can displace hydrogen attached to the peripheral carbon atoms and include any of the various forms of $R^{11}$–$R^{13}$, described above, as well as hydroxy and the thio (—S—) analogues of the oxy containing moieties—e.g., $—S—R^{15}$, where $R^{15}$ is hydrogen or any of the various forms of hydrocarbon moieties described in connection with $R^{11}$–$R^{13}$.

Varied forms of phthalocyanine dye chromophore containing monomers for incorporation in the ionic linear condensation polymers are disclosed by Krutak et al U.S. Pat. No. 5,292,855, the disclosure of which is here incorporated by reference.

Based on the entire ionic linear condensation polymer amounting to 100 mole percent, the phthalocyanine dye chromophore containing repeating units can account for from 1 molar part per million (mppm), $1\times10^{-4}$ expressed as mole percent, up to about 10 mole percent. The phthalocyanine dye chromophore containing repeating units preferably account for at least 1 mole percent of the total polymer.

The total amount of phthalocyanine dye present in the element is a function of the amount of anthraquinone present in the element. Counting each dye chromophore repeating unit as a separate molecule, it is contemplated to employ phthalocyanine dye in the range of from 1.0 to 40, preferably 5 to 25, mole percent, based on the moles anthraquinone dye present in the element.

As an alternative or supplement to incorporating a blue anthraquinone dye in the transparent film support, it is optionally and preferably contemplated to incorporate the anthraquinone dye as a repeating unit in an ionic linear condensation polymer. Except for the substitution of an anthraquinone dye chromophore for a phthalocyanine dye chromophore, the blue ionic linear condensation polymer can take any of the forms of the cyan ionic linear condensation polymer described above. Generally convenient physical handling properties are observed in the ionic linear condensation polymer containing the anthraquinone dye when overall molecular weights are maintained in the in the range of from about 10,000 to 100,000.

General descriptions of linear condensation polymers containing anthraquinone dye repeating units are provided by Davis et al U.S. Pat. No. 4,267,306 and Weaver et al U.S. Pat. Nos. 4,804,719, 5,372,719 and 5,384,377 and Krutak et al U.S. Pat. No. 4,999,418, all cited above and here incorporated by reference. The anthraquinone repeating units disclosed in these patents that produce blue polymers are specifically contemplated to be incorporated in the ionic linear condensation polymers employed in the practice of this invention.

A preferred class of anthraquinone monomers useful in forming repeating units in the ionic linear condensation polymers are represented by the formula:

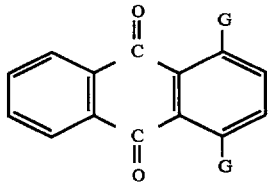

(XI)

where G is a reactive group $R^1$ or $R^2$, described above, which is preferably linked to the anthraquinone through a linking group. Synthetically convenient ring attachments of G that have preferred half-peak absorption bandwidths are realized when an amino nitrogen atom is bonded to the anthraquinone at its 1 and 4 ring positions. The amino nitrogen atom is then further substituted to provide a synthetically convenient linkage to the reactive group. For example, the amino nitrogen can be provided by an anilino group that is further substituted to provide a reactive group.

A specifically preferred class of anthraquinone dye chromophore containing monomers contemplated for incorporation in the ionic linear condensation polymers are those in which G satisfies the formula:

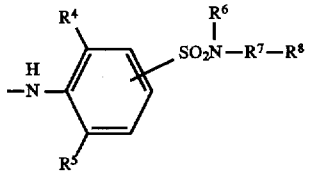

(XII)

wherein $R^4$ and $R^5$ are independently selected alkyl groups containing from 1 to 6 carbon atoms, preferably methyl or ethyl groups, and $R^6$, $R^7$ and $R^8$ are as described above.

Another specifically preferred class of anthraquinone dye chromophore containing monomers contemplated for incorporation in the ionic linear condensation polymers are those in which G satisfies the formula:

$$—NH—CH_2—C(R^{16})(R^{17})—CH_2—R_2—R^{18} \quad (XIII)$$

wherein $R^{16}$ and $R^{17}$ are independently selected alkyl groups containing from 1 to 6 carbon atoms, preferably methyl or ethyl groups; and $R^{18}$ is $R^1$ or $R^2$ or an alkylene group of 1 to 6 carbon atoms or an arylene group of 6 to 10 carbon atoms that contains $R^1$ or $R^2$ as a substituent, preferably a terminal substituent. Linking groups of this type are disclosed by Krutak et al U.S. Pat. No. 4,999,418, cited above and here incorporated by reference.

Based on the entire blue anthraquinone chromophore containing ionic linear condensation polymer amounting to 100 mole percent, the anthraquinone dye chromophore containing repeating units can account for from 1 molar part per million (mppm), $1\times10^4$ expressed as mole percent, up to the about 10 mole percent. The anthraquinone dye chromophore repeating units preferably account for at least 1 mole percent of the total polymer.

It is recognized that the phthalocyanine dye chromophore and the anthraquinone dye chromophore can, if desired, both form repeating units in the same condensation polymer. When all of the anthraquinone dye and phthalocyanine dye are present in the same condensation polymer, the optimum ratio of these two dyes is necessarily maintained, even when the coating coverages of the condensation polymer are varied to vary the overall density of the radiographic element.

The anthraquinone dye is incorporated in the radiographic element in an amount sufficient to provide a noticeable blue tint. Quantitatively, the anthraquinone dye is present in an amount sufficient to shift the b* value of the radiographic element to a value that is at least 0.7 more negative than it would otherwise be. Preferably the anthraquinone dye imparts to the radiographic element a minimum neutral density of at least 0.1. The anthraquinone dye can be incorporated in the transparent film support, as is conventional, or the anthraquinone dye can form a repeating unit of an ionic linear condensation polymer, as described above, and be incorporated in one or more hydrophilic colloid layers forming the radiographic element.

The ionic linear condensation polymer containing phthalocyanine dye described above is incorporated in one or more of the hydrophilic colloid layers of the radiographic element. Any amount of phthalocyanine dye can be incorporated that measurably reduces the transmission of red light through the radiographic element after it has been imagewise exposed and processed to produce a viewable image. It is preferred that the amount of phthalocyanine dye be chosen to shift negatively the a* values of the radiographic element at least 0.2. Preferably the a* value of the radiographic element is −5.0 or more negative. The phthalocyanine dye is incorporated in an amount that increases the minimum density of the radiographic element by an amount equal to or less than the minimum density increase created by the anthraquinone dye. Thus, the It is generally preferred that ionic linear condensation polymer containing phthalocyanine dye, anthraquinone dye, or a combination of both dyes account for less than half the weight of the hydrophilic colloid layer or layers in which it is incorporated. The maximum amount of dye from all sources that can be tolerated is that which increases the overall neutral density of the radiographic element to less than 0.3 (preferably less than 0.25) in minimum density areas following exposure and processing. Neutral density is determined from the specular transmission of white light through the radiographic element following imagewise exposure and processing.

EXAMPLES

The invention can be better appreciated by reference the following specific embodiments. Coating coverages, shown in parenthesis, are in units of mg/dm$^2$, unless otherwise indicated. ppm is used to indicate parts per million parts on a weight basis.

Elements 1–7

A series of radiographic elements were constructed by coating as described below on a clear, transparent polyester radiographic film support having a thickness of 7 mils (177.8 μm).

ILCP Dye AQ

A ionic linear condensation polymer containing an anthraquinone dye chromophore was prepared as follows: Components (a)–(g) comprising (a) 157.5 g (0.95 mole) isophthalic acid (b) 55.8 g (0.22 mole) 5-lithiosulfoisophthalate (c) 106 g (1.0 mole) diethylene glycol (d) 80.5 g (0.56 mole) 1,4-cyclohexane dimethanol (e) 1.9 g (0.023 mole) anhydrous sodium acetate (f) 200 ppm Ti catalyst as titanium-tetraisopropoxide and, (g) 35.0 g ($4.84\times10^{-2}$ mole) blue chromophore monomer, 1,4-bis[2-ethyl-x-(2-hydroxyethylsulfamoyl)-6-methylanilinolanthraquinone (an isomeric mixture in which x=3, 4 or 5), were added to a 1 L round bottom flask that was fitted with a stirrer, condensate take off, and nitrogen inlet head. The flask and contents were immersed into a salt bath and heated for two hours with stirring at about 230°–250° C., while esterification occurred. To carry out the polycondensation the temperature was increased to 250° C. and the flask was held under vacuum of ≦10 mm Hg for about 1 hour. The resulting polymer was dark blue with a weight average equivalent molecular weight of 21000 and $T_g$=~53° C. This polymer contained about 10% by weight, based on total weight, dye chromophore, and was readily soluble in hot water, producing a dark blue aqueous solution;

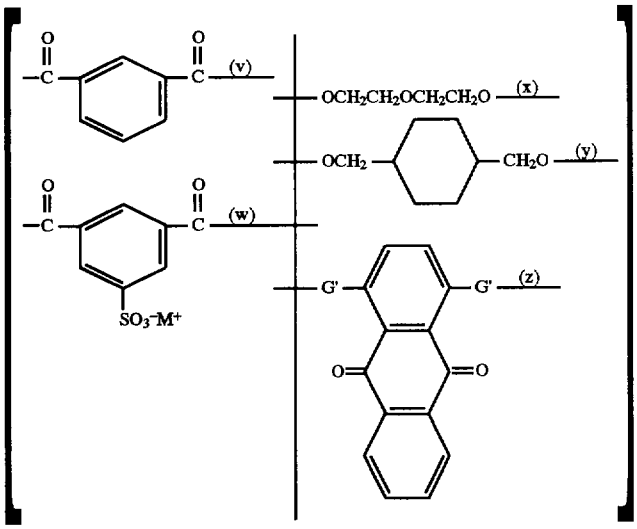

where

G' =

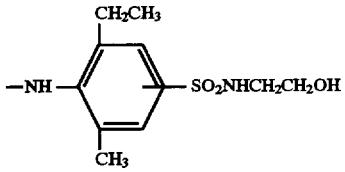

v=40.5 mole percent;
w=9.5 mole percent;
x=26.0 mole percent;
y=22.0 mole percent; and
z=2.0 mole percent.

ILCP Dye PC

A ionic linear condensation polymer containing a phthalocyanine dye chromophore was prepared as follows: Components (a)–(g) comprising (a) 161.0 g (0.97 mole) isophthalic acid (b) 57.1 g (0.23 mole) 5-lithiosulfoisophthalate (c) 108.4 g (1.02 moles) diethylene glycol (d) 82.3 g (0.57 mole) 1,4-cyclohexane dimethanol (e) 1.9 g (0.023 mole) anhydrous sodium acetate (f) 200 ppm Ti catalyst as titanium-tetraisopropoxide and, (g) 28.0 g ($3.1\times10^{-2}$ mole) copper x,y-bis(hydroxy-neopentylsulfamoyl)phthalocyanine (an isomeric mixture, in which x varies between 1, 2, 3 and 4, but is predominantly 2 and 3 and y varies between 15, 16, 17 and 18, but is predominantly 16 and 17), were added to a 1 L round bottom flask that was fitted with a stirrer, condensate take off, and nitrogen inlet head. The flask and contents were immersed into a salt bath and heated for two hours with stirring at about 200°–250° C., while esterification occurred. To carry out the polycondensation the temperature was increased to 250° C. and the flask was held under vacuum of ≦10 mm Hg for about 1 hour. The resulting polymer was cyan with a weight average equivalent molecular weight of 20000 and $T_g$=52° C. This polymer contained about 8% by weight, based on total weight, dye chromophore, and was readily soluble in hot water, producing a cyan aqueous solution;

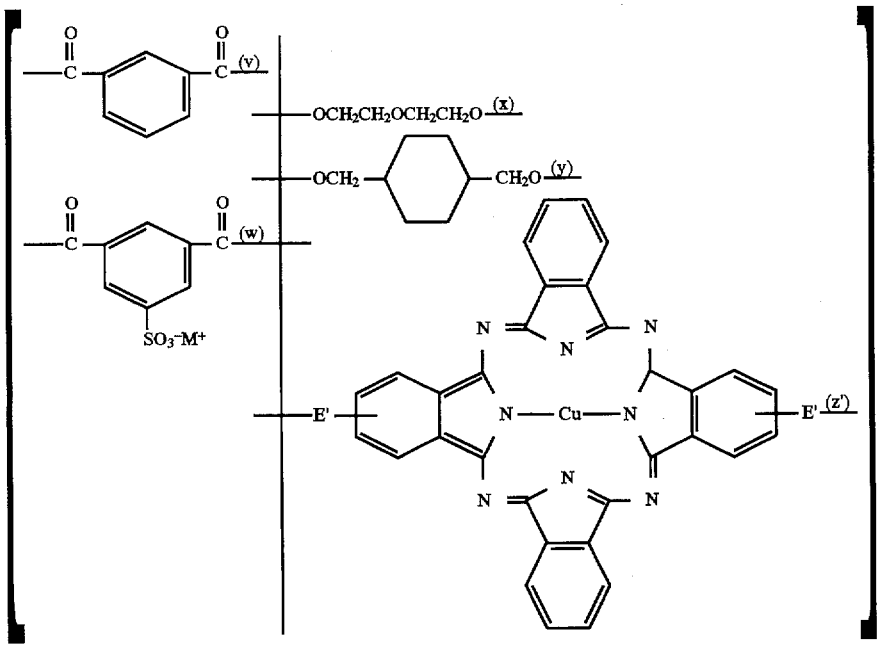

wherein

E'=—$SO_2NHCH_2C(CH_3)_2CH_2O$— v=40.5 mole percent;

w=9.5 mole percent;

x=26.25 mole percent;

y=22.5 mole percent; and z=1.25 mole percent.

ILCP Dye AQ/PC

A ionic linear condensation polymer containing both an anthraquinone dye chromophore and a phthalocyanine dye chromophore was prepared as follows: Components (a)–(h) comprising (a) 45.0 g (0.27 mole) isophthalic acid (b) 15.94 g (0.27 mole) 5-lithiosulfoisophthalate (c) 30.28 g (0.29 mole) diethylene glycol (d) 23.0 g (0.16 mole) 1,4-cyclohexane dimethanol (e) 0.54 g ($6.7\times10^{-3}$ mole) anhydrous sodium acetate (f) 200 ppm Ti catalyst as titanium-tetraisopropoxide, (g) 9.57 g ($1.32\times10^{-2}$ mole) blue chromophore monomer, 1,4-bis[2-ethyl-x-(2-hydroxyethylsulfamoyl)-6-methylanilino]anthraquinone (an isomeric mixture in which x=3, 4 or 5), and (h) 28.0 g ($3.1\times10^{-2}$ mole) copper x,y-bis(hydroxy-neopentylsulfamoyl)phthalocyanine (an isomeric mixture, in which x varies between 1, 2, 3 and 4, but is predominantly 2 and 3 and y varies between 10 15, 16, 17 and 18, but is predominantly 16 and 17), were added to a 500 mL round bottom flask that was fitted with a stirrer, condensate take off, and nitrogen inlet head. The flask and contents were immersed into a salt bath and heated for two hours with stirring at about 230°–250° C., while esterification occurred. To carry out the polycondensation the temperature was increased to 250° C. and the flask was held under vacuum of ≦10 mm Hg for about 2 hour and <1 mm Hg for an additional 20 minutes. The resulting polymer was dark blue with a weight average equivalent molecular weight of 22000 and $T_g$=~54° C. This polymer contained about 9.6% by weight, based on total weight, anthraquinone dye chromophore and 0.4% by weight, based on total weight, copper phthalocyanine dye chromophore. The polymer was readily soluble in hot water, producing a dark blue aqueous solution;

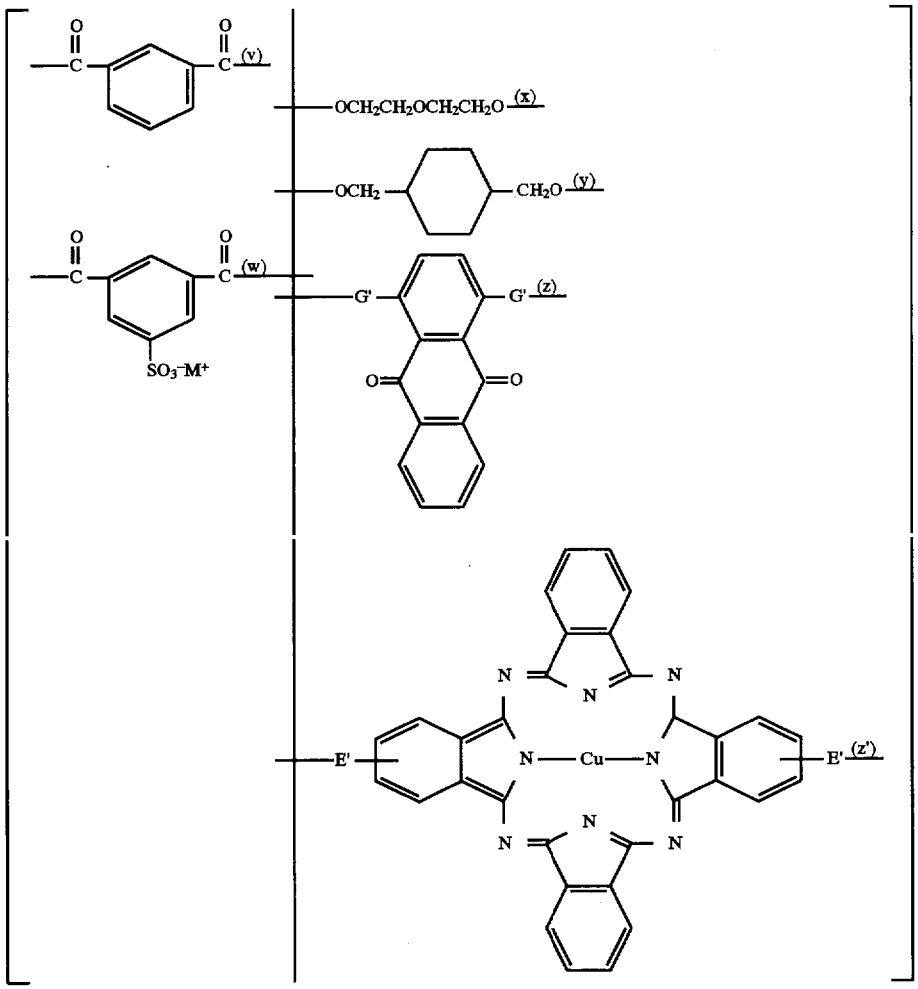

wherein

G'=

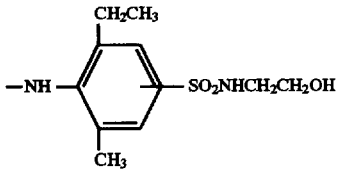

v=40.5 mole percent;

w =9.5 mole percent;

x=26.0 mole percent;

y=22.0 mole percent;

z=1.914 mole percent; and $z^1$=0.086 mole percent.

Coatings

Onto each major face of the support were coated the following layers, with the emulsion layer coated nearest the support:

| | |
|---|---|
| Surface Overcoat | |
| Gelatin | (3.4) |
| Methyl methacrylate anti-matte beads | (0.14) |
| Carboxymethyl casein | (0.57) |
| Colloidal silica | (0.57) |
| Polyacrylamide | (0.57) |
| Chrome alum | (0.025) |
| Resorcinol | (0.058) |
| Whale oil lubricant | (0.15) |
| Interlayer | |
| Gelatin | (3.4) |
| AgI Lippmann (based on Ag) (0.08 μm grains) | (0.11) |
| Carboxymethyl casein | (0.57) |
| Colloidal silica | (0.57) |
| Polyacrylamide | (0.57) |
| Chrome alum | (0.025) |
| Resorcinol | (0.058) |
| Nitron | (0.044) |
| Emulsion Layer | |
| AgBr tabular grains (based on Ag) (ECD 1.8 μm, thickness 0.13 μm) | (27.2) |
| Gelatin | (31.6) |
| ILCP Dye AQ and/or PC | see Table I |
| 4-Hydroxy-6-methyl-1,3,3A,7-tetraazaindene | 2.1 g/Ag mole |

-continued

| | |
|---|---|
| Potassium nitrate | (1.8) |
| Ammonium hexachloropalladate | ($2.2 \times 10^{-3}$) |
| Maleic acid hydrazide | ($8.7 \times 10^{-3}$) |
| Sorbitol | (0.53) |
| Glycerin | (0.57) |
| Potassium Bromide | (0.14) |
| Resorcinol | (0.44) |
| Bis(vinylsulfonylmethyl)ether based on total gelatin per side | 2.5 wt. %, |

The AgBr tabular grains were sulfur and gold sensitized and spectrally sensitized with 400 mg/Ag mole of the green absorbing spectral sensitizing dye anhydro-5,5'-dichloro-9-ethyl-3,3'-bis(3-sulfopropyl)oxacarbocyanine hydroxide, by the addition of 300 mg/Ag mole of KI.

Processing

To observe the image tone of the films tested in minimum density areas, the films were processed without exposure in a rapid access processor having the following processing cycle:

| | |
|---|---|
| Development | 27.6 seconds at 40° C. |
| Fixing | 18.3 seconds at 40° C. |
| Washing | 15.5 seconds at 40° C. |
| Drying | 21.0 seconds at 65° C. |

The following developer was employed:

| | |
|---|---|
| Hydroquinone | 30 g |
| 4-Hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-Methylbenzotriazole | 0.06 g |
| Glutaraldehyde | 4.9 g |
| Water to 1 Liter (pH = 10) | |

Image Tone

The image tone of the radiographic elements is reported in Table I below in terms of a* and b* values, measured at minimum density.

TABLE I

| | Dye | | | | |
|---|---|---|---|---|---|
| Film | AQ | PC | Total | a* | b* |
| A | (6.6) | None | (6.6) | −3.2 | −11.2 |
| B | (8.8) | None | (8.8) | −4.2 | −14.9 |
| C | (8.8) | (0.55) | (9.35) | −5.0 | −15.5 |
| D | (8.8) | (1.1) | (9.9) | −5.9 | −16.1 |
| E | (8.8) | (2.2) | (11.0) | −7.3 | −16.8 |
| F | (10.9) | None | (10.9) | −5.1 | −18.5 |
| G | (13.2) | None | (13.2) | −5.9 | −21.9 |

From Table I it is apparent that Elements C, D and E, containing a combination of the blue and cyan ionic condensation polymers offer the best overall balance of a* and b* values.

Comparing Elements A and B, lacking the cyan phthalocyanine dye chromophore, it is apparent that a relatively high proportion red light is still being transmitted through the elements while the b* values indicate image tones that are somewhat warmer than are generally sought.

The addition of the cyan phthalocyanine dye chromophore shifts b* values into an optimum range of common usage and simultaneously favorably reduces red light transmission, creating a* values of −5.0 or more negative. This achieves the aim of this invention of providing radiographic elements of a cold image tone that reduce eye strain by decreasing the proportion of transmitted red light.

Element F and G illustrate that larger overall amounts of dye are required to obtain a* values as negative as those provided Elements C, D and E when the blue anthraquinone dye chromophore is alone relied upon to shift a* values. Further, b* values are now driven to values more negative than those normally employed. This translates into undesirably increased overall neutral densities.

Thus, the present invention provides desirably cold image tones and overall neutral densities in the customary ranges of usage. At the same time, lower levels of red light transmission are realized.

By employing a combination of anthraquinone and phthalocyanine dyes as ionic linear condensation polymers coated on the support, a great deal of flexibility and convenience is afforded in manufacture. It is unnecessary to carry in inventory varied supports to meet different image tone preferences. Instead a single clear transparent support or, at most, a very few supports differing in neutral density are required to satisfying all end user preferences while providing superior image tone properties.

The invention has been described in detail with particular reference to preferred embodiments thereof, but it will be understood that variations and modifications can be effected within the spirit and scope of the invention.

What is claimed is:

1. A radiographic element comprised of a transparent film support having first and second major faces, hydrophilic colloid layers coated on at least one of the first and second major faces including at least one radiation-sensitive silver halide emulsion layer, and a blue anthraquinone dye forming a portion of at least one of the support and the hydrophilic colloid layers, WHEREIN, transmission of red light through the radiographic element when imagewise exposed and processed to produce a viewable image is reduced by the incorporation in at least one of the hydrophilic colloid layers of at least one ionic linear condensation polymer containing a cyan phthalocyanine dye.

2. A radiographic element according to claim 1 wherein the radiographic element exhibits a minimum density of less than 0.25 when imagewise exposed and processed.

3. A radiographic element according to claim 2 wherein the anthraquinone dye is present in an amount sufficient to shift image tone measured after imagewise exposure and processing in terms of a CIELAB b* value negative shift of at least 0.7.

4. A radiographic element according to claim 3 wherein the phthalocyanine dye is present in an amount sufficient to increase minimum density by an amount up to the amount by which the anthraquinone dye increases minimum density.

5. A radiographic element according to claim 4 wherein the cyan phthalocyanine dye is present in an amount sufficient to shift the image tone measured after imagewise exposure and processing in terms of a CIELAB a* value negative shift of at least 0.2.

6. A radiographic element according to claim 5 wherein the cyan phthalocyanine dye is present in an amount sufficient to provide a CIELAB a* value at least as negative as −5.0.

7. A radiographic element according to claim 1 wherein the ionic linear condensation polymer containing phthalocyanine dye is a polyester.

8. A radiographic element according to claim 7 wherein the ionic linear condensation polymer contains ionic repeating units.

9. A radiographic element according to claim 8 wherein the ionic repeating units are derived from a sulfo-substituted dicarboxylic acid.

10. A radiographic element according to claim 9 wherein repeating units of the cyan phthalocyanine dye exhibits the formula:

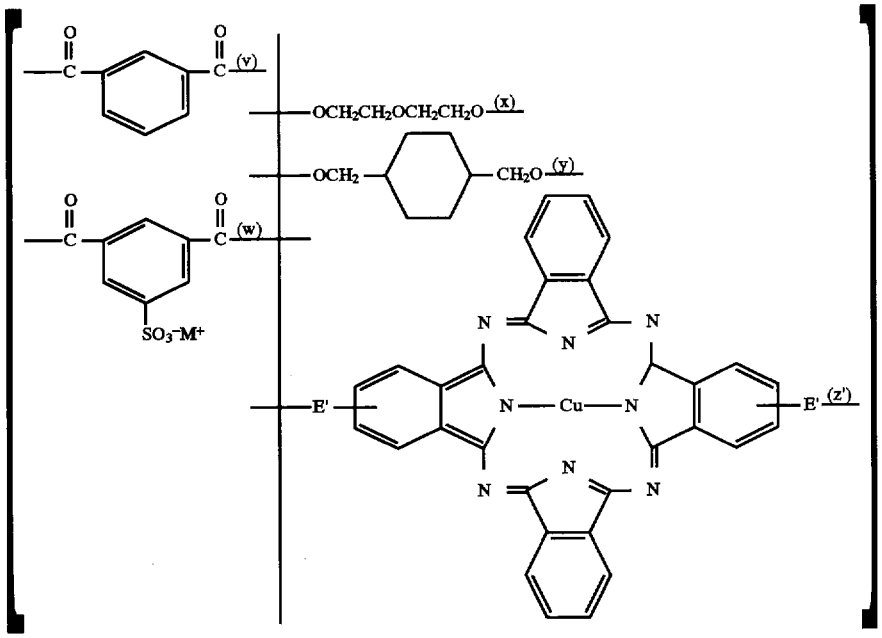

wherein

E'=—$SO_2NHCH_2C(CH_3)_2CH_2O$— v=50 mole percent less w;

w=$10^4$ to 40 mole percent;

x+y=50 mole percent less z; and z=$10^4$ to 10 mole percent;

and the repeating units are chosen to provide an overall molecular weight in the range of from 10,000 to 100,000.

11. A radiographic element according to claim 1 wherein the anthraquinone dye is incorporated in the transparent film support.

12. A radiographic element according to claim 1 wherein the anthraquinone dye forms a repeating unit in an ionic linear condensation polymer and is incorporated in at least one of the hydrophilic colloid layers.

* * * * *

UNITED STATES PATENT AND TRADEMARK OFFICE

CERTIFICATE OF CORRECTION

PATENT NO. : 5,744,294

DATED : April 28, 1998

INVENTOR(S) : Robert E. Dickerson
Rickey J. Seyler

It is certified that error appears in the above-identified patent and that said Letters Patent is hereby corrected as shown below:

Claim 10: Column 24, delete "$w=10^4$" and insert -- $w=10^{-4}$ --;

Claim 10: Column 24, delete "$z=10^4$" and insert -- $z=10^{-4}$ --.

Signed and Sealed this

Twenty-fourth Day of November, 1998

Bruce Lehman

*Attest:*

BRUCE LEHMAN

*Attesting Officer*

*Commissioner of Patents and Trademarks*